United States Patent [19]

Scott

[11] 4,416,703

[45] Nov. 22, 1983

[54] SYSTEM FOR REMOVING DEBRIS FROM PIPELINES

[75] Inventor: Paul R. Scott, Brazoria, Tex.

[73] Assignee: Shell Oil Company, Houston, Tex.

[21] Appl. No.: 323,170

[22] Filed: Nov. 20, 1981

[51] Int. Cl.[3] ..... B08B 9/04

[52] U.S. Cl. ..... 134/8; 15/104.06 R; 134/22.11

[58] Field of Search ..... 134/8, 22.11; 15/104.06 R; 137/1, 15; 252/8.55 B, 316

[56] References Cited

U.S. PATENT DOCUMENTS

| | | | |
|---|---|---|---|
| 2,402,796 | 6/1946 | Wood | 15/104.06 R |
| 3,108,012 | 10/1963 | Curtis | 134/8 X |
| 3,209,771 | 10/1965 | Gogarty et al. | 137/1 |
| 3,523,826 | 8/1970 | Lissant | 134/22.12 |
| 3,879,790 | 4/1975 | Girard | 15/104.06 R |
| 4,003,393 | 1/1977 | Jaggard et al. | 137/1 X |
| 4,216,026 | 8/1980 | Scott | 134/8 X |
| 4,254,559 | 3/1981 | Purinton | 34/12 X |

*Primary Examiner*—Richard V. Fisher

[57] ABSTRACT

To remove particulate debris from a pipeline, a plug train including at least one gel plug having debris entraining characteristics and at least one pseudoplastic plug is passed through a pipeline and the debris is collected by the gel plug. The gel plug is pushed through the pipeline with a scraper which in turn may be pushed by liquid or gas pressure.

9 Claims, 1 Drawing Figure

SYSTEM FOR REMOVING DEBRIS FROM PIPELINES

BACKGROUND OF THE INVENTION

A method for removing debris from pipelines with a gel plug is disclosed in U.S. Pat. No. 4,216,026. This method is an improvement over other methods used to remove debris from pipelines which include the use of scrapers, high velocity liquid flow and ordinary gel plugs. Thus, mechanical scrapers and ordinary gels tend to concentrate the debris, leaving it in thick beds along the bottom of the pipeline. In the case of high velocity liquid flow, adequate pump capacity and/or volume of fluid needed to remove the debris often are unavailable. By comparison, the method of U.S. Pat. No. 4,216,026 utilizes a Bingham plastic gel plug which is a flowable, nonthixotropic plastic composition having less moving shear stress at the wall of a pipeline than strength of adhesive bonding to the wall of the pipeline, to facilitate a peculiar type of flow which effectively entrains debris within the body of the gel plug. Thus, the Bingham plastic gel plug moves through the pipeline by a rolling or a circulating motion generating a closed toroid, the wall of the toroid adjacent the wall of the pipeline remaining relatively stationary and the center portion of the toroid moving in the flow direction, thereby entraining debris within the gel plug.

Even though the improvement over the prior art represented by the invention of U.S. Pat. No. 4,216,026 is substantial, it now has been discovered that other improvements can be made which even further increase the efficiency and effectiveness of this invention. Thus, it has been discovered that the trailing displacement fluid (normally water) employed to push a pig, scraper or separator and leading gel plug, has a tendency to by-pass forward, i.e., move past the separator and into the gel plug. This dilutes and/or otherwise destroys the debris carrying property of the gel. Accordingly, it is desirable to provide means which substantially eliminate or reduce by-pass forward of the trailing displacement fluid.

REFERENCE TO PERTINENT ART AND RELATED APPLICATIONS

The following U.S. patents are considered pertinent to the present invention: U.S. Pat. Nos. 4,040,974; 3,705,107; 4,052,862; 1,839,322; 3,425,453; 3,656,310; 3,751,932; 3,788,084; 3,842,612; 3,961,493; 3,978,892; 3,472,035; 3,777,499; 3,525,226; 3,890,693; 2,603,226; 3,523,826; 4,003,393; 3,833,010; 3,209,771; 3,272,650; 3,866,683; 3,871,826; 3,900,338; 4,064,318 and 4,076,628.

The following U.S. patent applications are considered relevant to the present invention: Ser. No. 823,810 filed Aug. 11, 1977, now abandoned; Ser. No. 11,823, filed Feb. 13, 1979, now U.S. Pat. No. 4,252,465; Ser. No. 932,395 filed Aug. 9, 1978, now abandoned; Ser. No. 836,876 filed Sept. 26, 1977, now abandoned; Ser. No. 116,506 filed Jan. 29,1980, now U.S. Pat. No. 4,379,722; Ser. No. 943,012 filed Sept. 18, 1978, now abandoned; and Ser. No. 8,990 filed Feb. 5, 1979, now U.S. Pat. No. 4,216,026.

SUMMARY OF THE INVENTION

The primary purpose of the present invention is to effectively and efficiently remove debris from a pipeline. This is accomplished by pushing a gel plug having debris entraining properties through the pipeline by means of a trailing displacement fluid. Dilution of the gel plug by the displacement fluid, resulting in loss of debris entraining properties of the gel plug, is prevented or reduced by separating the gel plug and displacement fluid with at least one separator such as a pig or scraper and at least one pseudoplastic plug.

Preferably, the separator is a hollow steel tubular body, is capable of carrying sonic devices, e.g., pingers or transponders, and is encircled with conical seal disks, preferably of hard urethane, which can collapse 40% or more of the pipe diameter without damage.

The gel plug preferably is a Bingham plastic which is one of the following: (1) A composition of a mineral oil and an organo-modified smectite, optionally including a particulate filler such as powdered coal; (2) a composition of water and a xanthan gum; (3) the composition of (2) wherein the xanthan gum has been cross-linked with a multivalent metal. Generally, the Bingham plastic plug is a flowable, non-thixotropic plastic composition having less moving shear stress at the wall of a pipeline than strength of adhesive bonding to the wall of the pipeline, to facilitate plug flow as above described.

The pseudo-plastic plug is preferably one of the following: (1) a water soluble polymer gel such as polyacrylamide, carboxymethylcellulose, or agar gum, or the like, preferably cross-linked with aluminum nitrate or an alkali metal nitrate, or the like; (2) a crude oil such as Ekofisk crude oil and a hydrocarbon gelling fluid such as an alkali metal or aluminum carboxylate, or more preferably a substituted aluminum ortho-phosphate. Generally, the pseudoplastic plug composition is a flowable plastic composition having a strength of adhesive bonding to the wall of a pipeline and moving shear stress at the wall of the pipeline which alternately exceed each other, giving the plug a viscoelastic flow characterized by erratic start-stop movement of random portions of the plug.

DESCRIPTION OF PREFERRED EMBODIMENT

Figure 1:
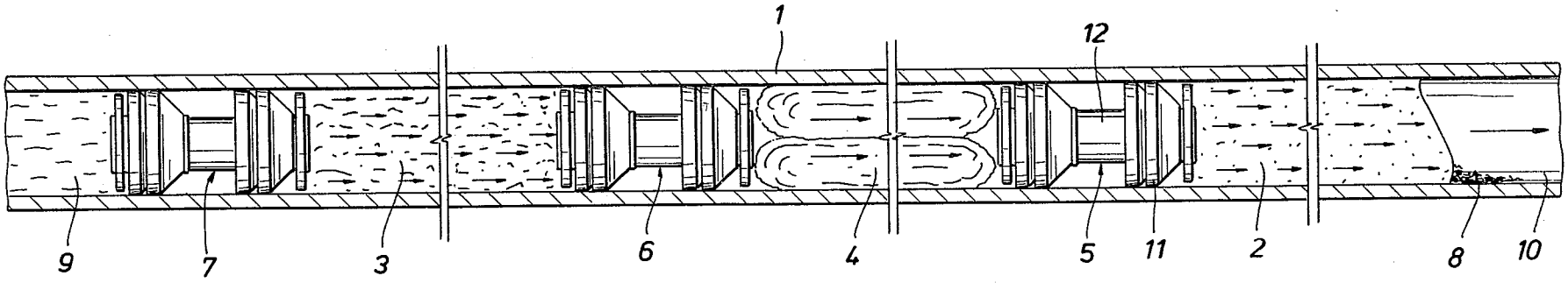
FIG. 1 shows the interior of a pipeline containing a plug train in accordance with the present invention.

As shown in FIG. 1, within a pipeline 1 is a series of plugs and pigs, scrapers or separators. The number of plugs and separators shown is merely exemplary and not intended as limiting. Plugs 2 and 3 are pseudoplastic and plug 4 is a plastic gel having debris entraining characteristics. The gel plug preferably is a Bungham plastic (see U.S. Pat. No. 4,216,026) such as one of the following: (1) A composition of a mineral oil and an organo-modified smectite, optionally including a particulate filler such as powdered coal; (2) a composition of water and a xanthan gum; (3) the composition of (2) wherein the xanthan gum has been cross-linked with a multivalent metal. Generally, the Bingham plastic plug is a flowable, non-thixotropic plastic composition having less moving shear stress at the wall of a pipeline than strength of adhesive bonding to the wall of the pipeline, to facilitate plug flow as above described.

The plugs are isolated from each other by separators 5 and 6. Separator 7 isolates plug 3 from a gas or liquid 9 utilized to force the plugs forward (left to right as shown) in pipeline 1 to pick up debris 8 and fluid 10. As shown by the arrows in FIG. 1, flow of plug 4 preferably follows a special manner. The fluid plastic in the center portion of plug 3 flows forward (left to right as shown) with little exchange of material with the fluid making up the annular flow region which is adjacent to the pipe wall and encases the center portion. The plastic fluid of the plug 4 circulates or rolls in a motion essentially generating a closed toroid, of generally eliptical cross-section, the wall of the toroid adjacent the wall of pipeline 1 remaining relatively essentially stationary to the direction of motion of plug 3 in pipeline 1. Sand, rust, weld slag, and other debris are entrained by the plastic fluid forming plug 4 in the vicinity of the wall of pipeline 1, moved into the center portion of plug 4 and carried down the length of plug 4. This mechanism results in distributing debris 8 throughout the length of plug 4 and continues until the plug is saturated.

While the primary purpose of the above described gel plug 4 is to entrain and carry debris out of a pipeline, a primary purpose of the hereinafter described pseudoplastic plugs 2 and 3 and separators 5–7 is to form a seal which keeps fluids out of the gel plug 4.

Separators 5–7 are used to remove the fluid 10 from and adjacent to the wall of pipeline 1 and force this fluid 10 to flow forward. Such separators can be inflatable spheres, compressible plastic plugs, conical disc plugs, flat disc plugs or combinations of these, and should (1) remove essentially all the fluid from the pipe walls and (2) prevent the trailing displacement fluid 9 from by-passing forward. Leaving fluid 10 on the wall would possibly deplete the debris-carrying gel batch 4 prematurely. If the displacement fluid 9 by-passes forward of the separator 7, this fluid 9 also could dilute and/or otherwise destroy the debris carrying property of the gel 4. By-passing of the displacement fluid 9 forward will normally occur at relatively low cleaning train flow velocities. The cleaning gel 4 will normally exhibit a higher flow resistance than the displacement fluid 9 because of their respective viscosities and yield values. There will be a significant pressure differential across the separators 5–7 while the cleaning system is flowing. Occasionally, large pressure differentials will occur when separators 5–7 encounter objects in the pipeline. The seal between separators 5–7 and the wall of pipeline 1 will be broken momentarily by debris 8 and imperfections at the pipe wall allowing the displacement fluid 9 to flow forward. Permanent damage to the resilient separator seal 11 may occur when it passes weld icicles and other stray protrusions at the pipe wall. Further, the relatively soft, resilient seal material 11 wears as separators 5–7 move through pipelines. Thus the displacement fluid may eventually flow forward continuously past damaged and worn separators, necessitating the use of pseudoplastic plugs 2 and 3, described hereinafter.

Three types of separators considered most useful for the cleaning train are: (1) inflatable polyurethane spheres, (2) open cell polyurethane foam plugs encased in an open weave polyurethane cover and (3) polyurethane disc supported by a steel body. However, the latter is preferred. Even more preferably, the preferred separators use four hard urethane scrapers and have dewatering discs at each end. This (1) decreases the tendency of the separator to become jammed if two came together while moving through the pipeline, (2) improves the flow pattern of the gel fluid at the gel-separator interfaces (3) makes the separators more bidirectional or reversable. Separators 5–7 have the ability to pass over debris and imperfections in pipelines and the ability to safely carry instruments within the steel tubular body 12. The conical shape of the disc 11 of the separator allows for more wear before losing the ability to seal. The pressure differential across the discs 11 tends to keep the conical disc expanded and against the wall of pipeline 1. The conical seal disc 11 could collapse 40% or more of the pipe diameter without damage. This would allow the separator to crawl over debris piles rather than bulldozing them up into a plug. Gel plug 4 is relied upon to pick up and carry such debris.

Means of locating the separators while passing through the pipeline 1 are essential. There is a possibility that one or more of the separators could jam or stop due to debris, imperfections, valves, and/or tees in the pipeline 1. It is imperative that the separator be located. To assure this, each separator is fitted with both pingers and transponders (not shown). These are sonic devices which send out a sound wave through the water surrounding the pipeline. The sound wave can be picked up by placing a microphone in the water within several thousand feet of the instrument, e.g., dropped into the water from boats, helicopters or from platforms. By moving the microphone to the location of the maximum signal strength, the separator can be located accurately. The separators can be identified because each carries a transponder which transmits at a separate and identifiable frequency.

However, wear and tear of the resilient seal material 11 of separators 5–7 cannot be prevented. Thus, for very long lines, significant by-passing may occur. The quantity flowing forward past a separator will depend primarily upon the pressure differential, the effective cross-sectional area of the leak and the rheological properties of the fluid behind the separator. The judicious use of separators and debris-carrying gels, are ways to minimize the effect of the by-passed fluid upon the rheology of the debris-carrying gel. For instance, long batches, concentrated batches, and separated batches of cleaning gels reduce the effect of dilution.

The bypass of the displacement fluid also is reduced by inserting sealing gel 3 behind the separator which separates the last batch of cleaning fluid 4 from the displacement fluid 9. The quantity of fluid bypassed depends partially upon the rheology of the fluid. A viscous fluid will bypass more slowly than a non-viscous fluid. A viscous plastic fluid which exhibits significant cohesive forces is better. Both the viscous and cohesive forces of the fluid must be overcome before this type of fluid will bypass forward. The cohesive forces are high relative to the adhesive forces between the fluid and pipe wall. This promotes annular flow and reduces the dilution of the seal fluid 3 by either the debris carrying fluid or displacement fluid. There is a possibility that a part or all of the seal fluid will bypass the separator 6. Thus, it is essential that the seal fluid be compatible with the debris carrying fluid.

The pseudoplastic plug is preferably one of the following: (1) a water soluble polymer gel such as polyacrylamide, carboxymethylcellulose, or agar gum, or the like, preferably cross-linked with aluminum nitrate or an alkali metal nitrate, or the like; (2) a crude oil such as Ekofisk crude oil and a hydrocarbon gelling fluid such as an alkali metal or aluminum carboxylate, or more preferably a substituted aluminum ortho-phosphate. Generally, the pseudoplastic plug composition is a flowable plastic composition having a strength of adhesive bonding to the wall of a pipeline and moving shear stress at the wall of the pipeline which alternately exceed each other, giving the plug a viscoelastic flow characterized by erratic start-stop movement of random portions of the plug. Examples of seal fluids are shown in Table I.

TABLE I

RHEOLOGY OF SEALING GELS

| Shear Rate, sec-1 | Shear Stress, dyne/cm$^2$ Water Base: Polyacrylamide Water 99 g Polymer 1 g | Water Base: (Reten 423)[1] Water 98.95 g Polymer 1 g $Al(NO_3)_3$ 0.05 g | Oil Base: Ekofisk Crude Oil Crude 300 ml MO55[2] 6.0 ml MO56[2] 2.5 ml |
|---|---|---|---|
| 1 | 102 | 207 | 90 |
| 3 | 161 | 620 | 186 |
| 5 | 185 | 860 | 303 |
| 11 | 233 | | 400 |

[1]Reten 423 a product of Hercules Inc.[2]MO55 and MO56 Two component hydrocarbon gelling agents products of Halliburton

What is claimed is:

1. A method for removing particulate debris from a pipeline comprising, inserting a debris entraining gel plug into the pipeline with at least one pseudoplastic plug; moving the gel plug through the pipeline by a circulating motion essentially generating a closed toroid, the wall of the toroid adjacent the wall of the pipeline remaining relatively stationary and the center moving in the direction of motion of the gel plug; collecting at least part of the particulate debris with the gel plug; moving the pseudoplastic plug through the pipeline by viscoelastic flow; sealing the gel plug from fluid in the pipeline with the pseudoplastic plug; isolating the gel plug from the pseudoplastic plug with a mechanical separator; and collapsing the separator up to 40% of the diameter of the pipeline while moving the separator over debris in the pipeline and while substantially maintaining the seal between the gel plug and pseudoplastic plug.

2. The method of claim 1, wherein the gel plug is between pseudoplastic plugs and a trailing mechanical separator prevents displacement fluid pushing the gel plug and pseudoplastic plug from displacing forward into the gel plug.

3. The method of claim 1, wherein the viscoelastic flow is characterized by erratic start-stop movement of random portions of the plug as adhesive attraction to the pipe and shear stress alternately exceed each other.

4. The method of claim 1, wherein the separator is a polyurethane conical disc supported by a steel body.

5. The method of claim 1, wherein the pseudoplastic plug comprises a high molecular weight polyacrylamide.

6. The method of claim 5, wherein the polyacrylamide is complexed with aluminum nitrate.

7. The method of claim 1, wherein the pseudoplastic plug comprises crude oil and a gelling agent.

8. The method of claim 4 wherein the separator includes at least four conical discs and has dewatering discs at each end.

9. The method of claim 1, wherein the gel plug is between pseudoplastic plugs and the separators each comprise at least four polyurethane conical discs supported by a steel body and having dewatering discs at either end of the steel body.

* * * * *